US009394681B2

(12) United States Patent
Brunhuber et al.

(10) Patent No.: US 9,394,681 B2
(45) Date of Patent: Jul. 19, 2016

(54) ANCHOR RAIL ARRANGEMENT

(71) Applicant: Hilti Aktiengesellschaft, Schaan (LI)

(72) Inventors: Thomas Brunhuber, Kaufering (DE); Holger Dirk Basche, Meiningen (AT); Ulrich Birnbaum, Epfenhausen (DE); Philipp Rainer Grosser, Buchs (CH); Markus Heudorfer, Buchs (CH)

(73) Assignee: HILTI AKTIENGESELLSCHAFT, Schaan (LI)

( * ) Notice: Subject to any disclaimer, the term of this patent is extended or adjusted under 35 U.S.C. 154(b) by 0 days.

(21) Appl. No.: 14/429,709

(22) PCT Filed: Sep. 19, 2013

(86) PCT No.: PCT/EP2013/069420
§ 371 (c)(1),
(2) Date: Mar. 19, 2015

(87) PCT Pub. No.: WO2014/044730
PCT Pub. Date: Mar. 27, 2014

(65) Prior Publication Data

US 2015/0240478 A1 Aug. 27, 2015

(30) Foreign Application Priority Data

Sep. 21, 2012 (DE) ..... 10 2012 216 957

(51) Int. Cl.
*E04B 1/41* (2006.01)

(52) U.S. Cl.
CPC ..... *E04B 1/4107* (2013.01); *E04B 1/4135* (2013.01); *E04B 2001/4192* (2013.01)

(58) Field of Classification Search
CPC ..... E04B 1/4107; E04B 1/4121–1/415; E04B 1/41; E04B 2001/4192
See application file for complete search history.

(56) References Cited

U.S. PATENT DOCUMENTS 827,613 A * 7/1906 Brown ..... 52/707
1,561,126 A * 11/1925 Timm ..... 52/254

(Continued)

FOREIGN PATENT DOCUMENTS

DE 2534908 A1 2/1977
DE 2631505 A1 1/1978

(Continued)

OTHER PUBLICATIONS

Machine translation of WO 03060249 A1, date pulled Aug. 9, 2015, p. 1-10.*
International Search Report for PCT/EP2013?069420, dated Nov. 27, 2013, 3 pages.

*Primary Examiner* — Elizabeth A Quast
(74) *Attorney, Agent, or Firm* — McAndrews, Held & Malloy, Ltd.

(57) ABSTRACT

The invention relates to an anchor rail arrangement with a concrete body which has two end faces which extend at an angle to one another and meet at an outer edge, and with two anchor rails which are embedded in the concrete body, wherein the two anchor rails each have a rail body with a longitudinal slot, wherein the longitudinal slot of the first rail body emerges on the first end face and the longitudinal slot of the second rail body emerges on the second end face on the concrete body, and wherein the two longitudinal slots extend in a common rail plane, wherein the first anchor rail has a plurality of first anchor bodies arranged on the first rail body, namely a first anchor body closest to the edge and at least one further first anchor body, and wherein the second anchor rail has a plurality of second anchor bodies arranged on the second rail body, namely a second anchor body closest to the edge and at least one further second anchor body. According to the invention, the first anchor body closest to the edge is a headless anchor bar and the second anchor body closest to the edge likewise is a headless anchor bar.

17 Claims, 2 Drawing Sheets

(56) References Cited

U.S. PATENT DOCUMENTS

| | | | | |
|---|---|---|---|---|
| 2,724,165 | A * | 11/1955 | Williams | 249/207 |
| 5,761,862 | A * | 6/1998 | Hendershot et al. | 52/271 |
| 8,132,388 | B2 * | 3/2012 | Nagy et al. | 52/745.05 |
| 2010/0162655 | A1 * | 7/2010 | Krell | 52/699 |
| 2010/0170185 | A1 * | 7/2010 | Birnbaum et al. | 52/699 |
| 2011/0000150 | A1 * | 1/2011 | Wurth et al. | 52/173.1 |
| 2011/0314764 | A1 * | 12/2011 | Basche et al. | 52/698 |
| 2013/0036679 | A1 * | 2/2013 | Nyce et al. | 52/105 |
| 2013/0327910 | A1 * | 12/2013 | Freeman | 248/231.91 |

FOREIGN PATENT DOCUMENTS

| | | | | |
|---|---|---|---|---|
| DE | 8509797 | U1 | 4/1985 | |
| DE | 4326322 | A1 * | 2/1995 | E04B 1/41 |
| DE | 19844308 | A1 | 3/2000 | |
| DE | 102010028349 | A1 | 11/2011 | |
| DE | 102010026505 | A1 | 1/2012 | |
| EP | 0121510 | A2 | 10/1984 | |
| EP | 0758039 | A1 | 2/1997 | |
| EP | 1067248 | A2 | 1/2001 | |
| WO | WO 03060249 | A1 * | 7/2003 | |

* cited by examiner

ANCHOR RAIL ARRANGEMENT

RELATED APPLICATIONS

The present application is filed pursuant to 37 U.S.C. 371 as a U.S. National Phase application of International Patent Application No. PCT/EP2013/069420, which was filed Sep. 19, 2013, and which claims priority to German Patent Application No. 102012216957.1, having a filing date of Sep. 21, 2012, both of which are incorporated herein by reference in their entirety.

BACKGROUND

Anchor rails are known as a means to subsequently mount elements to concrete bodies. Such anchor rails exhibit a C- or V-shaped rail body with a longitudinal slot to hold mounting elements, in particular T-head bolts, as well as a number of anchor bodies that are mounted on the rail body and cast into the concrete. The anchor bodies can be configured in particular as head bolts, i.e. as rods that are thicker on the end, so that especially high pulling forces can be introduced into the concrete body. When the maximum load is exceeded, head bolts of this type break out of the concrete body with the formation of a failure cone in the concrete.

Anchor rails for the subsequent mounting of elements to concrete bodies are known, for example, from U.S. Pat. No. 8,234,832.

Anchor rail arrangements that extend across a corner around the outer edge of a concrete body are known as well. With such an arrangement, façade elements in the edge area, for example, can be mounted at the same height. In an anchor rail arrangement set in near the edge, a continuous anchor rail that is bent around the desired edge angle, for example, can be used. Alternatively, a rail arrangement consisting of two anchor rail pieces can be used, which are welded together with a butt joint or a miter joint.

BRIEF SUMMARY OF THE DISCLOSURE

The invention concerns an anchor rail arrangement according to the preamble of Claim 1. Such an anchor rail arrangement is equipped with a concrete body, which exhibits a first front side and a second front side, whereby the two front sides are at an angle to one another and meet at an outer edge of the concrete body, and a first anchor rail and a second anchor rail that are embedded in the concrete body, whereby the first anchor rail exhibits a first rail body, in particular for the purpose of setting T-head bolts, with a longitudinal slot, and the second anchor rail exhibits a second rail body, in particular for the purpose of setting T-head bolts, with a longitudinal slot, whereby the longitudinal slot of the first rail body protrudes on the first front side on the concrete body and the longitudinal slot of the second rail body protrudes on the second front side on the concrete body, and whereby the two longitudinal slots run in a common rail level, whereby the first anchor rail further exhibits multiple first anchor bodies arranged on the first rail body, namely a first anchor body closest to the edge, which distinguishes itself by being mounted on the first rail body closest of all the first anchor bodies to the outer edge of the concrete body, and at least one additional first anchor body, and whereby the second anchor rail further exhibits multiple second anchor bodies arranged on the second rail body, namely a second anchor body closest to the edge, which distinguishes itself by being mounted on the second rail body closest of all the second anchor bodies to the outer edge of the concrete body, and at least one additional second anchor body.

The task of the invention is to provide an anchor rail arrangement for use near the edge that is both particularly simple and economical in its preparation, as well as particularly reliable in its use.

The task is solved according to the invention by an anchor rail arrangement with the characteristics of Claim 1. Preferred embodiments are listed in the dependent claims.

An anchor rail arrangement according to the invention is characterized in that at least the first anchor body closest to the edge is a headless anchor rod, and that at least the second anchor body closest to the edge is likewise a headless anchor rod.

One underlying concept of the invention can be seen in that at least the anchor bodies closest to the edge, in other words those anchor bodies that are closest to the outer edge between the two front sides and thus also closest to the respective adjacent anchor rail, are configured not as head bolts, but rather as headless anchor rods. Unlike a head bolt, such anchor rods do not exhibit thickening on the end, i.e. neglecting the ribs that typically occur on a reinforcing bar, their cross section does not increase with distance from the rail body, but rather it preferably remains constant.

The invention recognized that, under certain circumstances, the use of head bolts near an edge can be detrimental. Because, in the event of a tensile load exceedance, one single head bolt creates a failure cone going out from the head. If, however, the closest-to-the-edge anchor bodies of two anchor rails going across the corner are configured as head bolts, the corresponding heads are relatively close to one another for geometrical reasons. As a result, an overlap of the two failure cones can occur, which in turns leads to a relatively complex failure pattern. Under certain conditions, however, this can decrease the tensile loads. Moreover, the failure behavior can generally be theoretically predicted only with a comparatively large amount of effort, if at all, which can then necessitate correspondingly large safety margins and increased expense.

This is where the invention comes into play and envisages headless anchor rods as the anchor bodies near the edge. In the event of a load exceedance, such headless anchor rods, which can in particular be configured as reinforcing bars, generally do not create an appreciable failure cone. Rather, they are simply pulled out of the surrounding concrete in longitudinal direction. With that, according to the invention, overlapping failure cones and the associated complex, difficult-to-calculate failure patterns are avoided, so that the safety margins can be reduced accordingly without sacrificing reliability. In particular, the invention can provide the possibility of a conclusive analysis of the load capacity of anchor rails in the area of the corners of buildings based on standardized calculation methods. A software-implemented calculation and design model can allow the user to calculate the corner arrangement without the aid or validation of the manufacturer, and select the required anchor rails accordingly. This not only gives the user a time advantage, because he does not have to take the additional path through the manufacturer, he also obtains a conclusive analysis of the load capacity based on a standardized calculation model and does not have to rely on the manufacturer's assertions, which can often not be reproduced in detail.

The edge, for which the anchor rail arrangement according to the invention is intended, is an outer edge, i.e. in the area of this edge the concrete body protrudes convexly with both of its front sides. The outer edge does not have to be strictly linear; it can also be rounded. According to the invention, at least the anchor bodies are embedded in the concrete body. Preferably, the rail bodies are also at least partially embedded in the concrete body. The two front sides of the concrete body can in particular be flat surfaces. It is preferred that the longitudinal slots of the two rail bodies and/or the common rail level are perpendicular to the outer edge.

It is especially preferred that the two anchor rails, particularly the two rail bodies, be two separate parts that are not welded together. The embedded rail bodies are thus preferably attached to one another exclusively via the concrete body. Compared to an arrangement in which the two rail bodies are welded to one another, or are in one piece, a significantly simplified force distribution can be maintained in this type of arrangement, which facilitates a theoretical prediction of the failure behavior even more. In addition, this arrangement also has advantages for installation at the building site. Because for a corner arrangement with two not directly connected anchor rails, the two anchor rails can be inserted into the reinforcing cage separately, and unlike a rigid arrangement with directly connected rails, allowances for angle deviations at the front sides of the concrete body can be made very easily. In addition, fouling of the anchor rail arrangement with the existing reinforcement, which is relatively likely with a rigid corner design, can be avoided comparatively easily, and potential changes to the formwork can be reacted to without having to order a new product.

It is also advantageous that at least the first anchor body closest to the edge is a headless anchor rod designed to be a reinforcing bar and/or that at least the second anchor body closest to the edge is a headless anchor rod designed to be a reinforcing bar. The use of reinforcing bars is a particularly simple way to achieve an especially good anchor effect and especially good corrosion protection. The reinforcing bars preferably exhibit the usual large number of cross ribs on their outer surface. The dimensions (e.g. bond length, bending roller diameter, etc.) of the reinforcing bar are preferably designed to be able to make the most of the steel load-bearing capacity of the rail body.

A further advantageous configuration consists in that, in a top view with the line of sight down onto the common rail level and/or in a top view with the line of sight parallel to the outer edge, the first anchor body closest to the edge and the second anchor body closest to the edge intersect. This can be beneficial in terms of the load. Since, according to the invention, the anchor bodies closest to the edge do not create an appreciable failure cone, the two anchor bodies can be intersected with a relatively small amount of space without having a negative effect of the failure behavior.

It is furthermore preferred that at least one of the anchor bodies closest to the edge is angled at least once. This allows a fouling of the anchor bodies in the corner arrangement according to the invention to be easily avoided. In particular, both anchor bodies closest to the edge can initially be angled at least once, preferably in opposite directions.

It is especially advantageous that at least one of the anchor bodies closest to the edge is angled twice, so that it exhibits a first section and a second section running parallel and offset to the first section. According to the invention, the second section can be further away from the associated rail body than the first section. In particular, the anchor bodies closest to the edge of both rail bodies can be angled twice, so that they each exhibit a first section close to the rail body and a second section away from the rail body that is parallel and offset to the first section close to the rail body, whereby the second sections away from the rail bodies of the first and second anchor body closest to the edge are offset in opposite spatial directions. Fouling can be avoided particularly reliably through this and, at the same time, an especially compact configuration can be achieved. In particular, the two sections are offset in the direction perpendicular to the common rail level, whereby the two sections can be designed to align in a top view with the line of sight down onto the common rail level. Among other things, it is especially advantageous with regard to the manufacturing costs that all anchor bodies of at least one of the anchor rails are angled, in particular toward the same side of the rail.

Another useful further development is that at least one of the anchor bodies, particularly one of the anchor bodies closest to the edge, is connected to the corresponding rail body via a bushing. It is particularly preferred that the anchor body is screwed to the bushing and/or the bushing is screwed to the rail body. This is an especially simple way to realize a particularly reliable, especially corrosion-resistant connection. Alternatively, the anchor body can also be force fitted into the bushing.

In particular, it can be stipulated that each of the rail bodies exhibits two crosspieces, which restrict the longitudinal slot of the rail body, and which can be engaged from the back by the head of a T-head bolt arranged in the interior space of the rail body. The longitudinal slots extend along the length of the respective rail body.

The invention will be described in more detail in the following using preferred design examples that are schematically depicted in the attached figures, whereby individual characteristics of the design examples shown in the following can be realized in connection with the invention individually or in any combination. The figures schematically depict:

DETAILED DESCRIPTION

Figure 1:
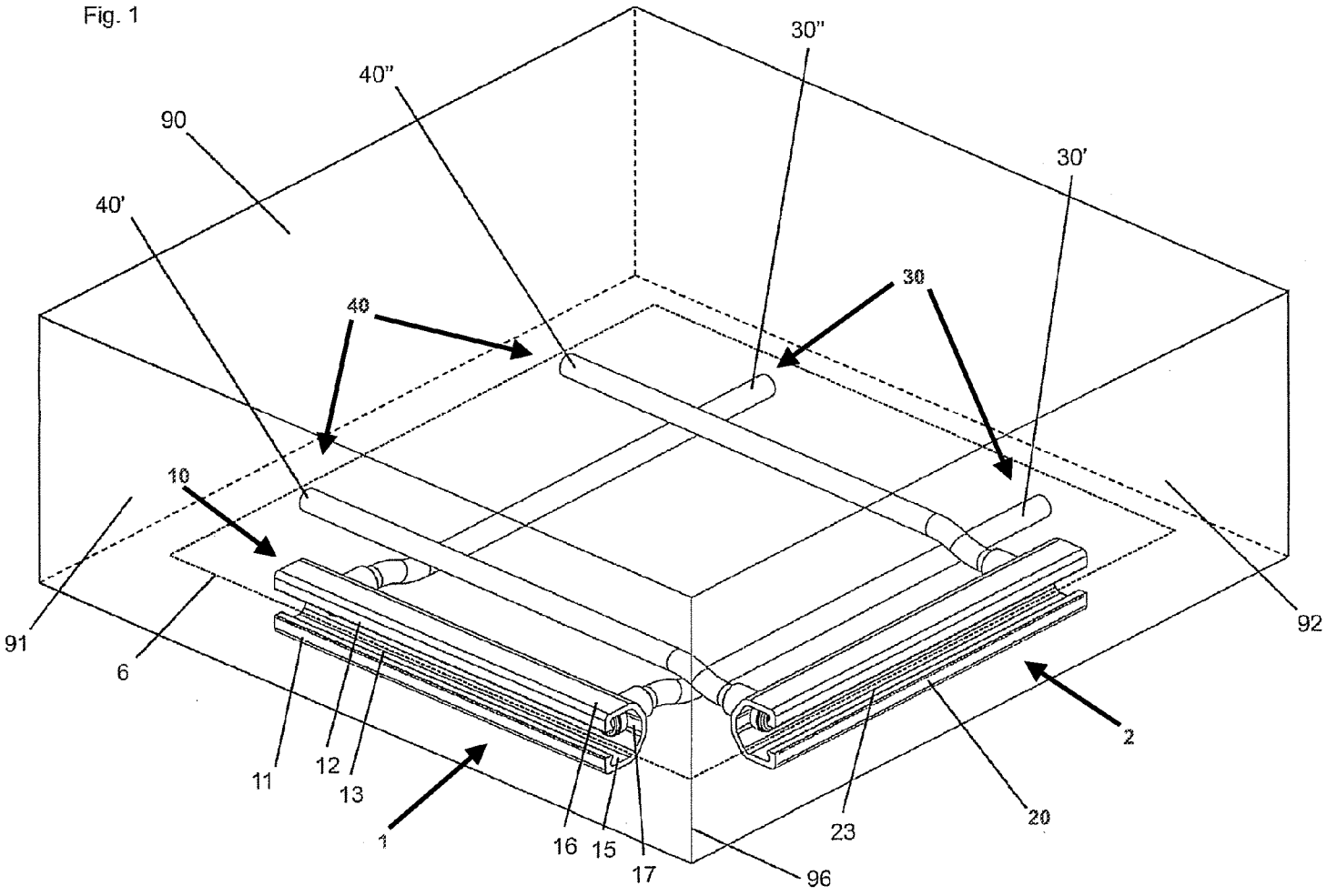
FIG. 1: a perspective illustration of an anchor rail arrangement according to the invention from the front, with a view onto both front sides on which the slots of the anchor rails protrude.
Figure 2:
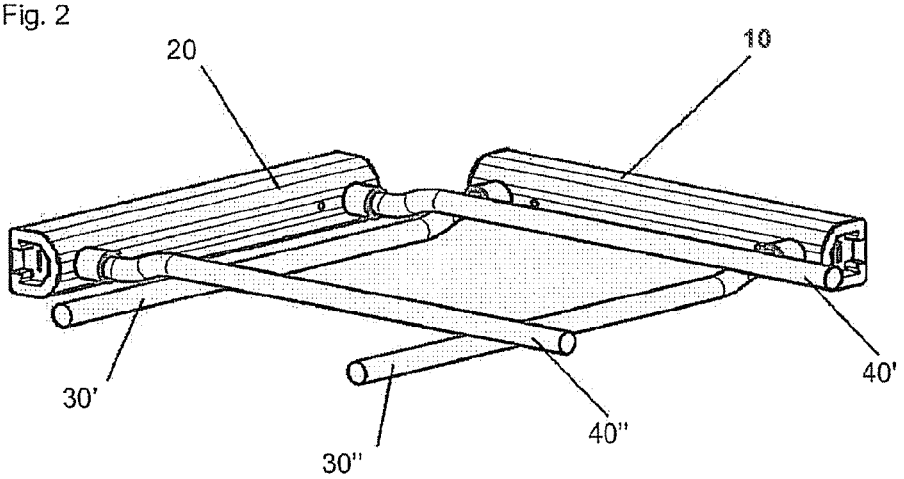
FIG. 2: a perspective illustration of the anchor rails of the anchor rail arrangement from FIG. 1 from the back, whereby end caps for the rail bodies are additionally shown in FIG. 2.

The figures show a design example of an anchor rail arrangement according to the invention. The anchor rail arrangement exhibits a concrete body 90 that, for the sake of clarity, is shown only in FIG. 1. The concrete body 90 exhibits a first vertical front side 91 as well as a second vertical front side 92, whereby the two front sides 91 and 92 are at an angle to one another and meet at a vertical outer edge 96. At this outer edge 96, the concrete body 90 protrudes convexly with both of its front sides 91 and 92.

The anchor rail arrangement further exhibits two separate anchor rails 1 and 2 that are embedded in the concrete body 90. The first anchor rail 1 exhibits a first rail body 10, on which multiple first anchor bodies 30 are mounted at a distance to one another.

Figure 3:
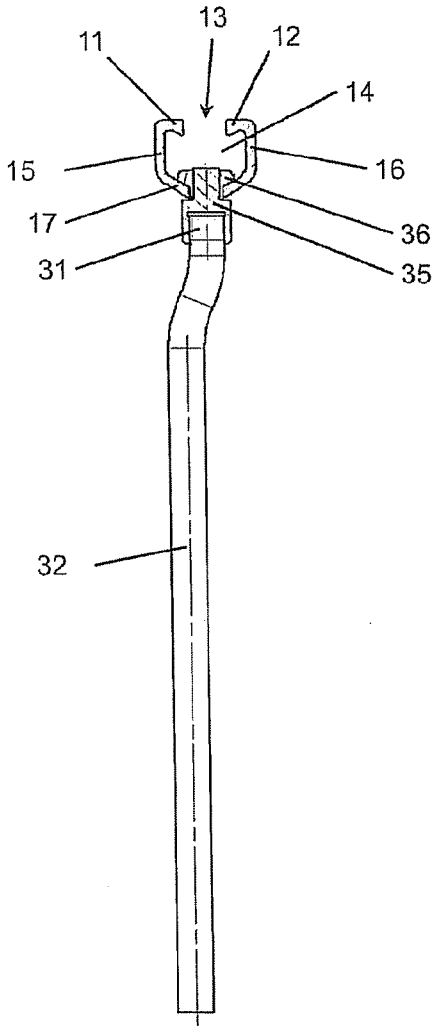
FIG. 3: a cross-sectional view through one of the anchor rails from the arrangement of FIGS. 1 and 2 in the area of an anchor body.

As can be seen in FIGS. 1 and 3 in particular, the first rail body 10 exhibits two side walls 15 and 16, preferably parallel to each other, that are connected by a base 17, whereby the base 17 in the present case has a V-shaped cross section, but can in principle also be designed to be flat, for example. The first anchor bodies 30 are connected with the first rail body 10 at the base 17 of the first rail body 10. A first crosspiece 11 on the first side wall 15 protrudes towards the second side wall 16. Correspondingly, a second crosspiece 12 on the second side wall 16 protrudes towards the first side wall 15. Between the two crosspieces 11 and 12 there is a longitudinal slot 13. The head of a T-head bolt can be inserted into the interior space 14 of the rail body 10 via this longitudinal slot 13, whereby the T-head bolt can then be positively locked to the two crosspieces 11 and 12 by being rotated around its longitudinal axis.

Analogous to the first anchor rail 1, the second anchor rail 2 exhibits a second rail body 20, on which multiple second anchor bodies 40 are mounted at a distance to one another. In the depicted design example, the second rail body 20 exhibits the same cross-sectional shape as the first rail body 10 and at most a different length, so that a detailed description of the shape of the second rail body 20 is unnecessary. Also the connection of the second anchor bodies 40 with the second rail body 20 is analogous to that of the first anchor rail 1. In principle, the two rail bodies 10 and 20 could also have a different cross-sectional shape, whereby the second rail body 20 always exhibits a longitudinal slot 23 as well, that leads into its interior space.

The two anchor rails 1 and 2 are arranged in the concrete body 90 in such a way that the first rail body 10, particularly its crosspieces 11 and 12 and/or the longitudinal slot 13 that lies in between, protrude on the first front side 91, and the second rail body 20, particularly its crosspieces and/or the longitudinal slot 23 that lies in between, protrude on the second front side 92. With that the two rail bodies 10 and 20 are at the same angle to one another as the two front sides 91 and 92, and are in particular perpendicular to one another. Linking parts can be mounted to the first front side 91 via the first anchor rail 1 and linking parts can be mounted to the second front side 92 via the second anchor rail 2. As can be seen in particular in FIG. 1, the two rail bodies 10 and 20 are arranged at the same height, i.e. the two longitudinal slots 13 and 23 lie on a common rail level 6. The common rail level 6 runs perpendicular to the preferred vertical outer edge 96. The two longitudinal slots 13 and 23 run in horizontal direction and/or perpendicular to the vertical outer edge 96.

As previously mentioned, the first anchor rail 1 exhibits multiple first anchor bodies 30, namely a first anchor body 30' closest to the edge that is mounted closest to the outer edge 96 on the first rail body 10, as well as at least one, in the depicted example exactly one, additional first anchor body 30". Similarly, the second anchor rail 2 exhibits multiple second anchor bodies 40, namely a second anchor body 40' closest to the edge that is mounted closest to the outer edge 96 on the second rail body 20, as well as at least one, in the depicted example exactly one, additional second anchor body 40".

According to the invention, at least the two anchor bodies 30' and 40' closest to the edge are configured to be headless; i.e. in the longitudinal direction they do not exhibit a significant increase of their cross section with increasing distance from the respective rail body 10 or 20, and in particular no end-sided thickening. At least the two anchor bodies 30' and 40' closest to the edge are configured as reinforcing bars and exhibit a large number of (not depicted) cross ribs. In the depicted design example, all the anchor bodies 30 and 40 are configured headless as reinforcing bars, not only the two anchor bodies 30' and 40' closest to the edge.

As is shown particularly in FIG. 3, the first anchor body 30' closest to the edge is angled twice and exhibits a first section 31 and a laterally offset, parallel second section 32. As is shown particularly in FIG. 1, the second anchor body 40' closest to the edge is also angled twice so that it exhibits a first section and a laterally offset, parallel second section. The deflection of the first anchor body 30' closest to the edge, however, points in the opposite direction to that of the second anchor body 40' closest to the edge, so that, viewed in the direction of the outer edge 96, the two second sections are at different levels. Therefore, as shown particularly in FIG. 1, the two anchor bodies 30' and 40' closest to the edge can be arranged in such a way that, in a top view with the line of sight down onto rail level 6 and/or parallel to the outer edge 96, they intersect, without colliding. It is the two second sections in particular that intersect. In the depicted design example, the remaining anchor bodies 30" and 40" are also angled in the same manner as the respective anchor bodies 30' and 40' closest to the edge.

In principle, the anchor bodies 30, 40 could be directly connected to the respective rail body 10 or 20. In the present design example, however, as shown in FIG. 3 using the example of the first anchor rail 1, an indirect mount is provided. The first anchor body 30' is screwed into a bushing 35, and the bushing 35 is in turn screwed into a rivet 36 that is riveted to the rail body 10. The remaining anchor bodies 30, 40 can be mounted in the same manner.

As a rule, the threaded connection between the rivet 36 and the bushing 35 must be protected from corrosion, which can be ensured e.g. with a patch applied in advance or an anticorrosive agent applied directly to the thread during assembly. The side of the thread visible from the interior of the rail, in other words the side of the screwed in bushing 35 that is exposed to the atmosphere (in a product solution without a bushing 35, this is the side of the thread of the anchor body) must, as a rule, also be protected from corrosion.

This can occur on the production side already with an anticorrosive coating (e.g. zinc), or be accomplished later with the aid of anticorrosive sprays/paints or the like. In addition, corrosion protection must generally be provided for the connection between the bushing and the anchor body. In the case of threaded connections between the various components, a means to prevent unscrewing is generally needed (e.g. with the aid of a sticky coating according to DIN 267-27). For alternative joining techniques (e.g. according to DIN 8593-0) it must, as a rule, be ensured that the connection is secured against unscrewing.

On its front side facing the outer edge 96 of the concrete body 90, the rail body 10 of the first anchor rail 1 can exhibit a not-depicted foam end cap. This end cap can ensure that forces in the anchor rail 1, directed toward the outer edge 96, are primarily conducted via the first anchor body 30, and with that deep within the concrete body 90, into the concrete body 90. Premature failure in the area of the outer edge 96 can thus be avoided. In the same manner, the rail body 20 of the second anchor rail 2 can also exhibit a not-depicted foam end cap on its front side facing the outer edge 96 of the concrete body 90.

What is claimed is:

1. An anchor rail arrangement for a concrete body having a first front surface and a second front surface that meet at an adjoining outer edge of the concrete body, the anchor rail arrangement comprising:

a first anchor rail embedded in the concrete body, the first anchor rail comprising:

a first rail body embedded in the first front surface of the concrete body such that a first longitudinal slot of the first rail body is accessible from the first front surface of the concrete body; and a plurality of first anchor bodies mounted on the first rail body; and a second anchor rail embedded in the concrete body, the second anchor rail comprising:

a second rail body embedded in the second front surface of the concrete body such that a second longitudinal slot of the second rail body is accessible from the second front surface of the concrete body; and a plurality of second anchor bodies mounted on the second rail body;

wherein the first longitudinal slot and the second longitudinal slot align along a common rail level for the first front surface and the second front surface;

wherein a first anchor body of the plurality of first anchor bodies, that is closest to the adjoining outer edge of the concrete body, comprises a first headless anchor rod, wherein a second anchor body of the plurality of second anchor bodies, that is closest to the adjoining outer edge of the concrete body, comprises a second headless anchor rod, and wherein the first headless anchor rod is angled at least once to permit the first headless anchor rod and the second headless anchor rod to cross and retain the common rail level of the first anchor rail and the second anchor rail.

2. The anchor rail arrangement of claim 1, wherein:

the first anchor rail and the second anchor rail are two separate parts; and the first anchor rail is not welded to the second anchor rail.

3. The anchor rail arrangement of claim 1, wherein:

the first headless anchor rod comprises a first reinforcing bar; and the second headless anchor rod comprises a second reinforcing bar.

4. The anchor rail arrangement of claim 1, wherein the first headless anchor rod is angled twice so that a first section of the first headless anchor rod is parallel to, but offset from a second section of the first headless anchor rod.

5. The anchor rail arrangement of claim 1, wherein:

the first headless anchor rod comprises threads that permit the first headless anchor rod to be connected to a bushing by screwing the first headless anchor rod into the bushing, and the bushing comprises threads that permit the bushing to be connected to the first rail body by screwing the bushing into the first rail body.

6. The anchor rail arrangement of claim 1, wherein:

the first rail body comprises a first crosspiece along a first edge of the first longitudinal slot and a second crosspiece along a second edge of the first longitudinal slot;

wherein the first crosspiece and second crosspiece are configured to receive a head of a T-head bolt inserted between the first crosspiece and the second crosspiece, and engage the head of the inserted T-head bolt when the T-head bolt is turned after being inserted.

7. An anchor rail installation, comprising a concrete body comprising a first surface having a first outer edge, and a second surface having a second outer edge, wherein the first surface is angled with respect to the second surface, and wherein the first outer edge of the first surface abuts the second outer edge of the second surface to form an outer edge of the concrete body;

a first anchor rail embedded in the concrete body, the first anchor rail comprising:

a first rail body embedded in the first surface of the concrete body such that a first longitudinal slot of the first rail body is accessible from the first surface of the concrete body; and a plurality of first anchor bodies mounted on the first rail body; and a second anchor rail embedded in the concrete body, the second anchor rail comprising:

a second rail body embedded in the second surface of the concrete body such that a second longitudinal slot of the second rail body is accessible from the second surface of the concrete body; and a plurality of second anchor bodies mounted on the second rail body;

wherein the first longitudinal slot and the second longitudinal slot align along a common rail level for the first surface and the second surface;

wherein a first anchor body of the plurality of first anchor bodies, that is closest to the outer edge of the concrete body, comprises a first headless anchor rod, and wherein a second anchor body of the plurality of second anchor bodies, that is closest to the outer edge of the concrete body, comprises a second headless anchor rod.

8. The anchor rail installation of claim 7, wherein:

the first anchor rail and the second anchor rail are two separate parts; and the first anchor rail is not welded to the second anchor rail.

9. The anchor rail installation of claim 7, wherein:

the first headless anchor rod comprises a first reinforcing bar; and the second headless anchor rod comprises a second reinforcing bar.

10. The anchor rail installation of claim 7, wherein the first headless anchor rod and the second headless anchor rod cross.

11. The anchor rail installation of claim 7, wherein the first headless anchor rod is angled at least once to permit the first headless anchor rod and the second headless anchor rod to cross and retain the common rail level of the first anchor rail and the second anchor rail.

12. The anchor rail arrangement of claim 7, wherein the first headless anchor rod is angled twice so that a first section of the first headless anchor rod is parallel to, but offset from a second section of the first headless anchor rod.

13. The anchor rail arrangement of claim 7, wherein:

the first headless anchor rod comprises threads that permit the first headless anchor rod to be connected to a bushing by screwing the first headless anchor rod into the bushing, and the bushing comprises threads that permit the bushing to be connected to the first rail body by screwing the bushing into the first rail body.

14. The anchor rail arrangement of claim 7, wherein:

the first rail body comprises a first crosspiece along a first edge of the first longitudinal slot and a second crosspiece along a second edge of the first longitudinal slot;

wherein the first crosspiece and second crosspiece are configured to receive a head of a T-head bolt inserted between the first crosspiece and the second crosspiece, and engage the head of the inserted T-head bolt when the T-head bolt is turned after being inserted.

15. An anchor rail installation, comprising a concrete body comprising a first vertical surface having a first vertical edge and a second vertical surface having a second vertical edge, wherein the first vertical surface is angled with respect to the second vertical surface, and wherein the first vertical edge of the first vertical surface abuts the second vertical edge of the second vertical surface to define a corner of the concrete body;

a first rail body embedded in the first vertical surface of the concrete body such that a first longitudinal slot of first rail body horizontally traverses at least partially across the first vertical surface and is accessible from the first vertical surface of the concrete body;

a second rail body embedded in the second vertical surface of the concrete body such that a second longitudinal slot of second rail body horizontally traverses at least partially across the second vertical surface and is accessible from the second vertical surface of the concrete body;

a plurality of first anchor bodies embedded in the concrete block and mounted to the first rail body; and a plurality of second anchor bodies embedded in the concrete block and mounted on the second rail body;

wherein the first longitudinal slot and the second longitudinal slot align along a common rail level for the first vertical surface and the second vertical surface; and wherein a first anchor body of the plurality of first anchor bodies, that is closest to the corner of the concrete body, comprises a first headless anchor rod, and a second anchor body of the plurality of second anchor bodies, that is closest to the corner of the concrete body, comprises a second headless anchor rod.

16. The anchor rail arrangement of claim 15, wherein the first headless anchor rod and the second headless anchor rod cross.

17. The anchor rail arrangement of claim 15, wherein the first headless anchor rod is angled at least once to permit the first headless anchor rod and the second headless anchor rod to cross and retain the common rail level of the first anchor rail and the second anchor rail.

* * * * *